US011001091B2

(12) United States Patent
D'Alessandro

(10) Patent No.: US 11,001,091 B2
(45) Date of Patent: May 11, 2021

(54) POSTCARD

(71) Applicant: ABC MARKETING S.R.L., Bologna (IT)

(72) Inventor: David D'Alessandro, Bologna (IT)

(73) Assignee: ABC MARKETING S.R.L., Bologna (IT)

( * ) Notice: Subject to any disclaimer, the term of this patent is extended or adjusted under 35 U.S.C. 154(b) by 0 days.

(21) Appl. No.: 16/645,291

(22) PCT Filed: Aug. 28, 2018

(86) PCT No.: PCT/IT2018/050164
§ 371 (c)(1),
(2) Date: Mar. 6, 2020

(87) PCT Pub. No.: WO2019/049185
PCT Pub. Date: Mar. 14, 2019

(65) Prior Publication Data
US 2020/0369067 A1 Nov. 26, 2020

(30) Foreign Application Priority Data
Sep. 6, 2017 (IT) ..... 102017000099592

(51) Int. Cl.
*B42D 15/00* (2006.01)
*B42D 15/02* (2006.01)
*B42D 15/04* (2006.01)

(52) U.S. Cl.
CPC ..... *B42D 15/027* (2013.01); *B42D 15/045* (2013.01)

(58) Field of Classification Search
CPC .... A01G 9/029; B42D 15/045; B42D 15/027; B65D 73/0035; B65D 85/52; B65D 75/28;
(Continued)

(56) References Cited

U.S. PATENT DOCUMENTS 4,209,945 A * 7/1980 Dent ..... A01G 9/00 229/117.12
2003/0204992 A1* 11/2003 Poret ..... A01C 1/04 47/73
2009/0198589 A1* 8/2009 Castineiras ..... A01G 9/029 705/26.1

FOREIGN PATENT DOCUMENTS

EP 0 514 811 11/1992
FR 2584983 A1 * 1/1987 ..... B65D 75/326
(Continued)

OTHER PUBLICATIONS

Abcmarketingbo: "Eco-Postcard è0 il gadget ecologico dal cuore vivente!" (English translation: "Eco-Postcard is the ecological gadget with a living heart!"), youtube, Apr. 23, 2015 (Apr. 23, 2015), p. 1 pp., XP054978291, Retrieved from the Internet: URL:https://www.youtube.com/watch?v=aF9_pyhGgNU, [retrieved on Apr. 26, 2018] the whole document.

*Primary Examiner* — Cassandra Davis
(74) *Attorney, Agent, or Firm* — Leason Ellis LLP

(57) ABSTRACT

The following invention represents a postcard, comprising a laminar body adapted to be decorated externally with at least one predefined illustration. Said body has an opening for access to an internal recess, said opening is normally closed by a removable cover. The recess accommodates at least one seed and a substrate, and that at least one seed is arranged on the top of the substrate and directed toward said opening, for the sprouting of a plant after the removal of the cover and the addition of water into the recess. The seed is normally being retained on the top of said substrate by a laminar containment element, which is made of water-soluble material and is interposed between the substrate and the cover.

8 Claims, 4 Drawing Sheets

(58) Field of Classification Search
CPC ..... B65D 75/327; B65D 75/36; B65D 2575/3245; A01C 1/04
See application file for complete search history.

(56) References Cited

FOREIGN PATENT DOCUMENTS

| | | | | |
|---|---|---|---|---|
| GB | 2281713 A | * | 3/1995 | ..... B42D 15/042 |
| GB | 2 304 624 | | 3/1997 | |
| WO | WO 94/00975 | | 1/1994 | |

* cited by examiner

POSTCARD

CROSS-REFERENCE TO RELATED PATENT APPLICATIONS

This application is a U.S. National Phase Application under 35 U.S.C. § 371 of International Patent Application No. PCT/IT2018/050164, filed Aug. 28, 2018, which claims the priority of Italian Patent Application No. 102017000099592, filed Sep. 6, 2017, all of which are incorporated by reference, as if expressly set forth in their respective entireties herein.

TECHNICAL FIELD

The following invention represents a postcard.

BACKGROUND

It is something widely acknowledged that all around the world people use to send postcards to their friends and relatives. It consists generally in a rectangular-shaped thin cardboard, which carries an illustration on one side and a blank space where a brief message can be written on the other.

Usually, the sender buys and sends the postcard during holidays or whenever she/he's away from home in a way to dedicate a wish or a thought to a faraway person. In this context, the illustration of the postcard reproduces a more or less representative image of the place where the sender is.

More recently, due to the broad expansion of new means of communication, such as e-mails and/or smartphones, this main way of using postcards progressively decreased (even if it has not disappeared yet, for sure), even though it is still very easy to find postcards in souvenir, gadget and gift shops, with some of them showing new designs too.

In fact, postcards are being commercialized as a promotional object or illustrated souvenirs more and more often: they are not being sent anymore, but they are being kept or given to somebody instead, especially as a reminder of special places or events.

As they do not especially need to be sent, newly designed postcards often include a heterogeneity of shapes, materials, dimensions and new features in order to be more captivating for the clientele.

SUMMARY

For this reason, the main purpose of the following invention is to develop a postcard able to raise the interest of the customer thanks to a peculiar feature.

In this way, one of its purposes is to develop a postcard, whose peculiar feature may be used in a simple and practical way.

Another purpose of the object is to develop a postcard that ensures a high operating reliability.

One more purpose is to propose a postcard that adopts a different technical and structural architecture from the usual types of postcards.

Furthermore, another purpose is to develop a postcard which is easy to produce starting from commonly available and eco-friendly raw materials.

One last purpose is to develop a postcard with reasonable productive costs and easy to be sold.

This goal and the ones who will get clearer afterwards will be reached by a postcard, comprising a laminar body adapted to be decorated externally with at least one predefined illustration, characterized in that said body has an opening for access to an internal recess, said opening being normally closed by a removable cover, said recess accommodating at least one seed and a substrate for said at least one seed, arranged on the top of said substrate, directed toward said opening, for the sprouting of a plant following the removal of said cover and the addition of water in said recess, said at least one seed being normally retained on the top of said substrate by a laminar containment element, which is made of water-soluble material and is interposed between said substrate and said cover.

BRIEF DESCRIPTION OF THE DRAWING FIGURES

Further features and benefits of the invention will come up more by the description of the preferred, but not exclusive way of using the postcard according to the invention, in the following pictures, where:

FIGS. from 1 to 4 show some of the steps to produce the postcard, according to the invention, in axonometric projection;

DETAILED DESCRIPTION OF CERTAIN EMBODIMENTS

Figure 1:
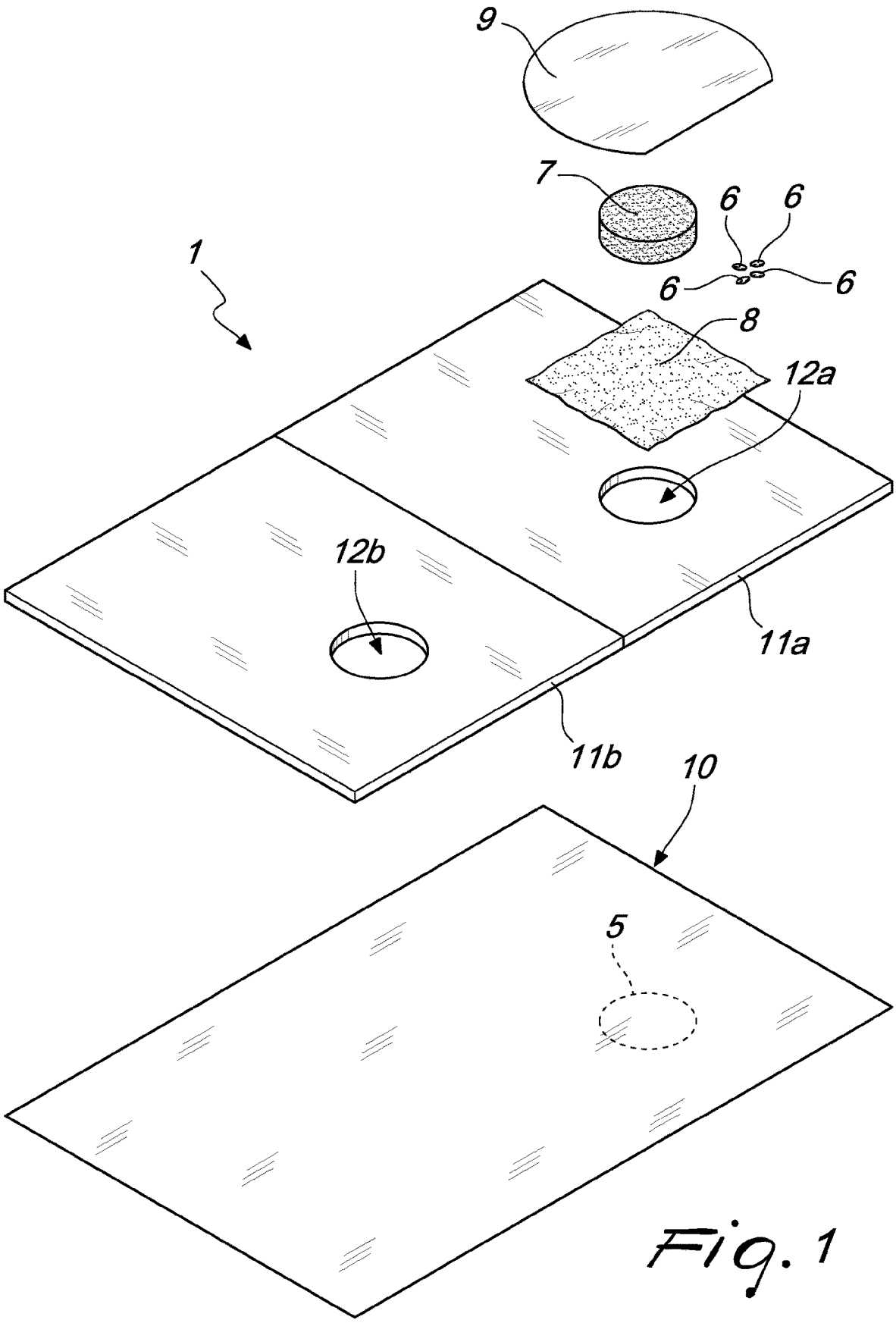

Referring especially to the cited figures, it is globally mentioned with the referring number 1 a postcard comprising a laminar body 2 adapted to be decorated externally with at least one predefined illustration 3.

It is specified from now on that postcard 1, according to the invention, can be commercialized and bought expecting its shipping (following the most common and widely consolidated way of use).

Alternatively, postcard 1 can be simply be sold as a souvenir, a gift and/or a memory of a place (like a tourist destination, an art city, a museum, a monument, etc.), an event (such as an exhibition, a theatrical, musical, sport or cinema event, etc.), or even more.

Illustration 3 can remind of that place or event or even be chosen depending on whatsoever criteria or customizing logic whose goal is to meet the expectations of the potential clientele and/or represent a captivating gift item.

All the possibilities already mentioned represent potential uses of the invention: at the same time more and different uses are not being excluded, in case they respect the claimed protection.

According to the invention, body 2 presents an opening for access to an internal recess 4 (which is realized in body 2's thick part).

The opening is usually closed by a removable cover 5: in FIGS. 5 and 6, cover 5 is being shown as partially removed (and sketched in FIG. 6), in order to keep visible recess 4 itself, and the other elements located in these (which will be described further in the next paragraph).

In order to confer a peculiar feature to postcard 1, recess 4 accommodates at least one seed 6 and a substrate 7 for said seed 6, which is arranged on the top of substrate 7 itself, said top is directed towards the opening (and cover 5).

The presence of substrate 7 and seed 6 allows the sprouting of a plant following the removal of cover 5 and the addition of water in recess 4: in this way the prefixed goal is being fulfilled, as it confers a further feature to the invention, surely captivating and able to raise the interest of the potential customer.

It is also important to mention that, although it is possible to commercialize postcards 1 containing a single seed 6, it is preferred to accommodate more than one seed 6 (they can be either of the same kind or of different kinds altogether as well) inside of each recess 4, so as to increase the chances for the-plant to grow successfully and/or to obtain an even more pleasant effect.

From now on, whenever we will refer to the adoption of "a seed 6", the concepts hereby explained are to be extended also to the use of two or more seeds 6, always to be arranged on the top of substrate 7—

It is also appropriate to underline the fact that seeds 6 may be chosen of any kind, without losing the hereby claimed protection. In fact, only as a mere example, we suggest that those seeds 6 should be flowers (morning glory, sunflower, moonflower, forget-me-not, etc.), aromatic plants (sage, basil, fennel, etc.), vegetables (zucchini, Romanesco, eggplant, melon, tomato, chili pepper, etc.), and so on.

Figure 6:
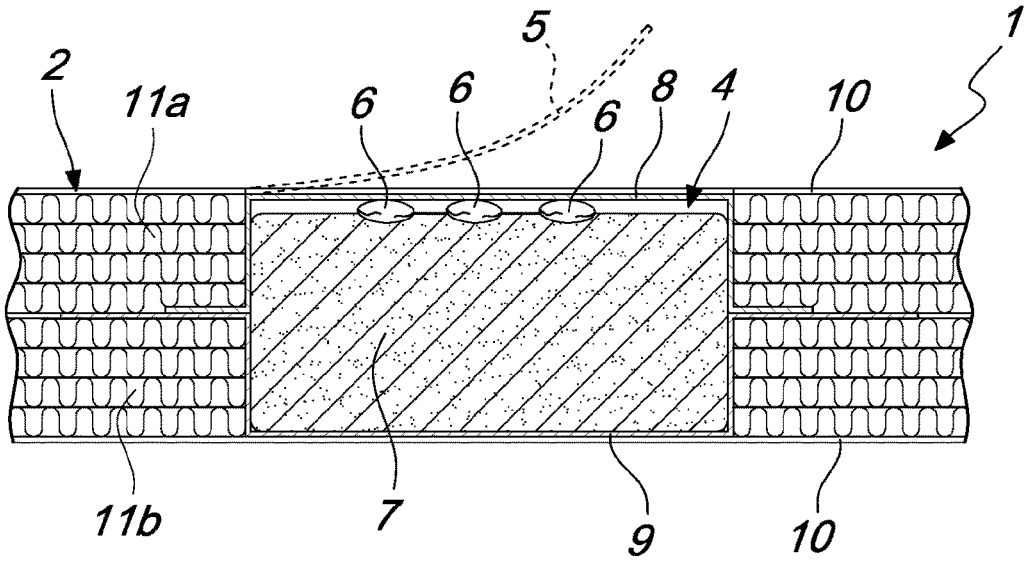
FIG. 6 is a section of FIG. 5, on the axis VI-VI.
Figure 7:
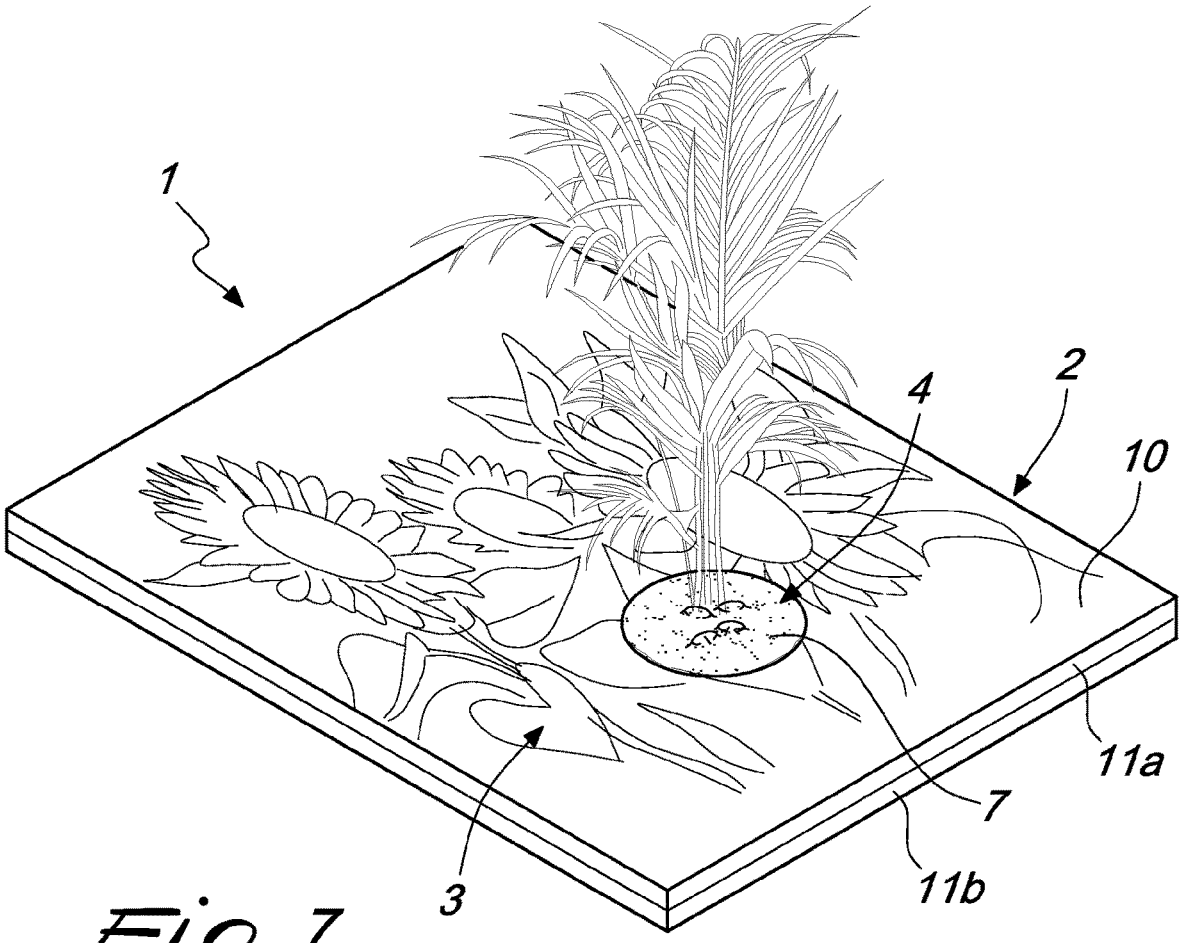
FIG. 7 shows FIG. 5 postcard, in axonometric projection, after the sprouting of a plant.

Moreover, seed 6 (each seed 6) is normally kept on the top of substrate 7 by a laminar containment element, which is made of water-soluble material and is interposed between substrate 7 and cover 5 (as it is shown in FIG. 6). The necessity of the laminar element 8 is a clearly evident, such as the choice of realizing it in water-soluble material.

In fact, laminar element 8 keeps seeds 6 steady on the top of substrate 7, avoiding the danger of moving and sliding on the sides of substrate 7 or even inside body 2 itself until coming out of it entirely (as it will be further explained, in the preferred use of the invention, this cardboard is not fully thick, but it is corrugated). In the absence of laminar element 8, this danger is quite present especially for the smaller seeds 6, which can be normally used as part of postcard 1 according to the invention.

At the same time, the choice of realizing said element 8 in a water-soluble material assures its dissolution as soon as water is being put into recess 4.

This leaves the final user with the only preliminary task of removing cover 5, without having to worry about laminar element 8, which, if it had not been realized in water-soluble material, would oppose itself to the natural growth of the plant and/or would damage seeds 6 themselves.

In particular, in the preferred realization of the application of the invention, proposed also in the attached figures in an explicative and not limitative way, laminar element 8 is a piece of water-soluble textile wrapped around the top of substrate 7 and seed 6.

In this setting, any water-soluble textile can be adopted, in function of the specific needs.

With further reference to the preferred, but not exclusive solution, substrate 7 is a rigid block of material that ensures the optimal rooting of the plan, following the addition of water in recess 4, and presents both shape and dimensions that substantially correspond to those of recess 4 itself, so that it stably fits into body 2.

For example, in the attached figures, recess 4 and substrate 7 have both a cylindric shape and substantially correspondent dimensions allowing substrate 7 to fill almost completely recess 4 itself so that it can be stably accommodated in it.

More particularly, not excluding the use of other materials (also in function of the specific seed 6 that will be allocated inside recess 4), substrate 7 is made of dried coconut pith fibre.

Said choice reveals itself of an extremely practical interest: coconut pith fibre gives seeds 6 a superior ventilated substrate 7 in the first place. As it has been demonstrated by several quality checks, its chemical-physical properties are in fact ideal to guarantee the optimal rooting environment.

Furthermore, coconut not only is a fine quality substrate (as a matter of fact, it has RHP quality certificate, which is well known and highly appreciated in the sector) but is also an ecological product resulting of fair trade. For many years the raw material has been considered as waste, and poor countries such as India or Sri Lanka, who are rich in it, have not found a way to use it. Due to the development of a special organic composting process, now it is possible to take advantage of this material as substrate 7, which ensures an important contribution to the development of the local economy in India and Sri Lanka by giving the postcard 1 an additional value.

Usefully, substrate 7 is at least partially wrapped in a containment net (usually, but not exclusively elastic), in order to prevent its dispersion and leakage. Said net preferably wraps substrate 7 on its sides and on the bottom, that is, on the opposite side of laminar body 8, which guarantees the protection and the contention of the topsoil that does not come out of postcard 1. Conveniently, postcard 1 comprises a film 9 made of water-repellent material (aluminium, for example): said film is interposed between recess 4 and substrate 7 opposite to the opening (and relative cover 5), to contrast the diffusion of water and humidity into recess 4.

Not excluding the possibility of realizing body 2 as a single piece, in a relevant practical interest implementation, body 2 comprises a plate-like structure and at least one covering sheet 10.

Said plate-like structure is made out (preferably but not exclusively) of cardboard or other cellulose-based material and is provided with recess 4.

For example, said structure can be 1 cm thick, so that it allows the successful accommodation of substrate 7 in an adequately-dimensioned recess 4.

In particular, postcard 1's structure is a product of the paper-transformation industry, which is the result of the overlap and the sticking together of more layers of cardboard and corrugated cardboard (for example, of "micro triple" kind, which is 5 mm thick). Although, it is not excluded the possibility of using different cellulose-based, biodegradable and environmentally friendly materials.

It is important to notice that corrugated cardboard (displayed only in FIG. 6 section) represents an absolutely eco-friendly solution because its fibres are 100% biodegradable and recyclable. In the hereby described process, it is preferably made of renewable raw materials, that is a virgin fibre that comes from sustainably-managed forests whose replanting plans are higher than cutting ones. Adhesive substances have a natural origin as well because they come from corn or potato starch, while for the illustrations the inks used are water based and have a low environmental impact. Corrugated cardboard is completely recycled throughout the recovery of the paper for pulping, strongly contributing to the waste disposal process.

In turn, covering sheet 10 is ready to be decorated with the predefined illustration 3 and is stably applied (at least) on the side of the plate-like structure that has the opening: as it is shown in the attached figures, cover 5 is constituted by a pre-cut flap of sheet 10 which is aligned with the opening itself.

It is also specified that on both contraposed sides of the base structure are preferably being applicated the respective covering sheets 10, in order to provide a decoration of postcard 1 on both sides.

In addition, in this context, recess 4 is preferably made directly through the plate-like base structure (making easier the production as a whole) and being covered on both sides by the respective sheets 10.

For example, sheet 10 (each sheet 10) is made in FSC printed paper: as known, "FSC" is a registered mark and stands for "Forest Stewardship Council", that is an international NGO which involves a high number of subjects, such as environmentalist groups, forest owners, indigenous groups, large-scale retailer groups, researchers and production and distribution companies.

Said organization promotes all over the world the good forest management (such as environmental, economic and social aspects) and fixes unique certification criteria that can be applied voluntarily by third parts along the whole forest-wood production chain.

Once again, this choice allows to match postcard 1, according to the invention, with the values of eco-friendliness and sustainable development.

Still referring to the preferred, but not exclusive, practical solution, illustration 3 (previously developed) is reproduced on sheet 10 through typographic or digital printing.

More precisely, in the proposed way of production also in the attached figures (whose purpose is illustrative and not limitative), the structure is composed of two plate-like portions 11*a* and lib which have substantially identical shape and dimensions and are folded in a clamshell fashion and are joined at a common edge. As a matter of fact, by the common edge of the two portions of the structure, the continuity of the cardboard (and, of course, of the plate-like structure) is interrupted by being cut through by an incision (which can be obtained in different ways, like die-cutting, for example) which unites the two portions 11*a*, lib only along a thin edge. In the solution now introduced, recess 4 is substantially constituted by the respective cavities 12*a*. 12*b* (once portions 11*a*, lib are closed in a clamshell fashion) realized in the relative portions 11*a*, lib.

In said solution, postcard 1 can be obtained through a production process with a relevant practical interest, as it can be easily done by hand and however effortlessly mechanizable. Even this process is object of the present treaty, which consists, first of all, in an a. phase, in applying covering sheet 10, eventually already decorated with predefined illustration 3 (as already said, by typographic or digital printing, for example), on at least one part of a corrugated cardboard piece, or any other cellulose-based material.

Covering sheet IO's adhesion (which will constitute the plate-like structure, afterwards) is obtained, for example, by gluing.

Subsequently, in a b. phase, the procedure establishes to die-cut the plate in order to define (through the adequate pressing) at least of the two portions 11*a*, lib (that said, body 2's plate-like structure), which end up mutually laterally adjacent, joined at said common edge and are provided with said cavities 12*a*, 12*b*.

More precisely, the union in correspondence (only) of the common edge and cavities 12*a*, 12*b* (preferably passing through) are obtained with the hollow punch used during b phase.

In this way, at least on the first portion 11*a*, covering sheet 10 has already been applied. However, it is to be noted that with this procedure it is possible to cover both sides of the plate-like structure with the same covering sheet 10 (reducing costs and production times), as it is applied on the cardboard plate before it is die-cut and closed in a clamshell fashion.

Obviously, starting from an only adequately-shaped plate (and eventually an only sheet 10), with an only die-cut it is possible to obtain a certain number of first portions 11*a* united to the respective second portions lib (in standard shapes, for example: 10×10 cm, 10×20 cm, 20×15 cm, 10×15 cm, etc.) in order to reduce further costs and production times.

It is important to remind that it is not excluded to produce separate portions 11*a*, lib, which will be glued together afterwards so that to obtain body 2's plate-like structure.

Subsequently, the procedure establishes, in a c. phase, to place, on the opposite side of covering sheet 10, laminar element 8 on the first portion 11*a* in correspondence to the respective cavity 12*a*.

An important fact is that laminar element 8 it is chosen to be bigger than cavity 12*a*, 12*b* (and substrate 7), in order to be able to wrap itself even partially around substrate 7's sides and remain more effectively tightened between it and recess 4's lateral surface.

Figure 2:
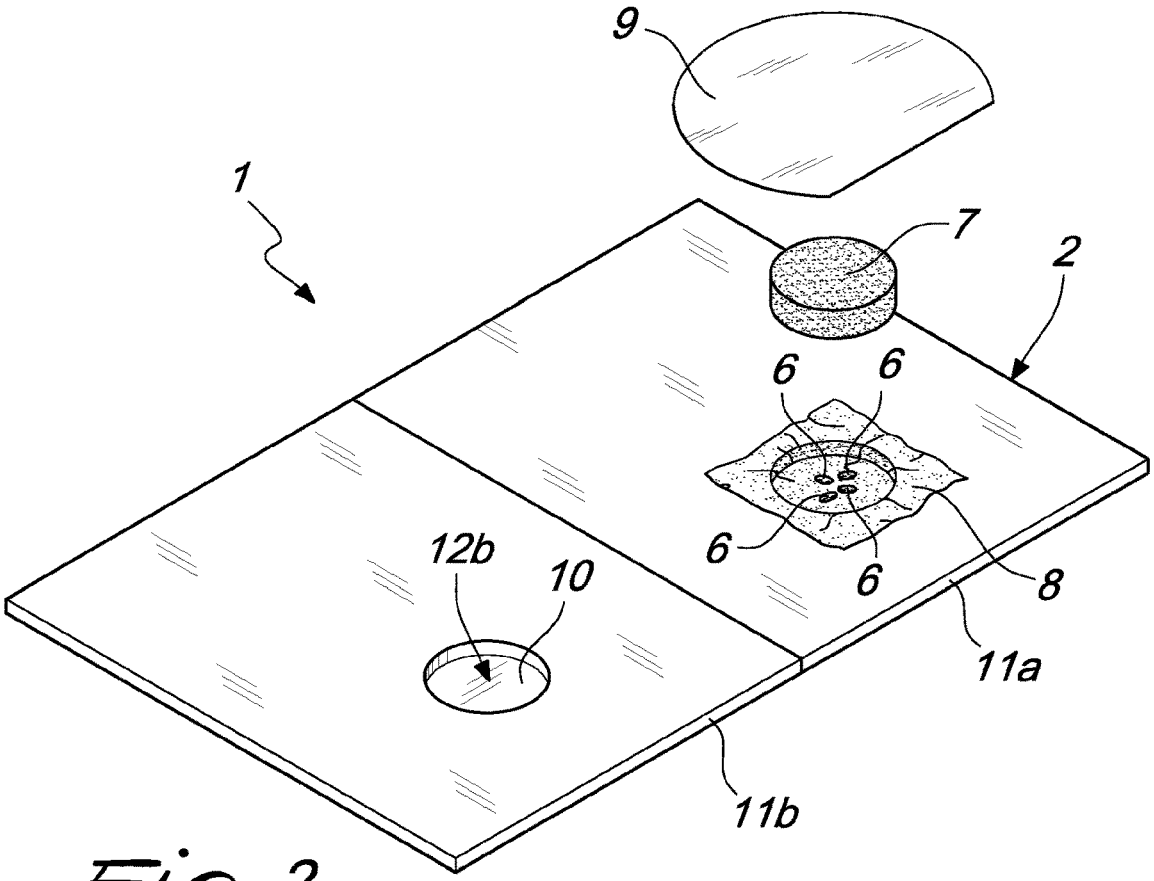

After having completed c. phase, in a d. phase the procedure establishes to dispose seed 6 (or seeds 6) onto laminar element 8 on the top of the correspondent cavity 12*a* of the first portion 11*a*. In this way the obtained structure is the one schematically represented in FIG. 2.

Figure 3:
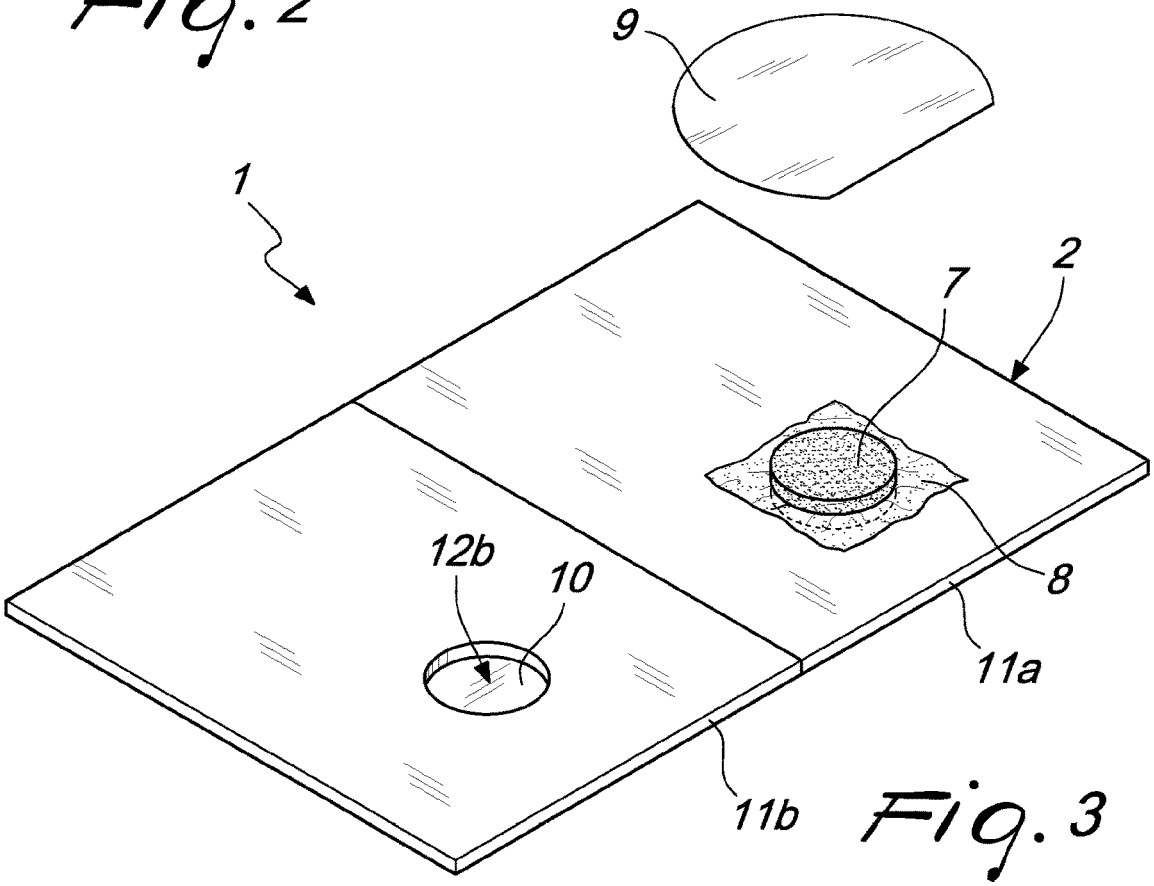

Afterwards, in a e. phase, the procedure establishes to introduce substrate 7 into the cavity 12*a* of the first portion 11*a* (onto seeds 6), in order to block laminar element 8 between substrate 7 and covering sheet 10. The temporary configuration obtained is the one schematically illustrated in FIG. 3.

Figure 5:
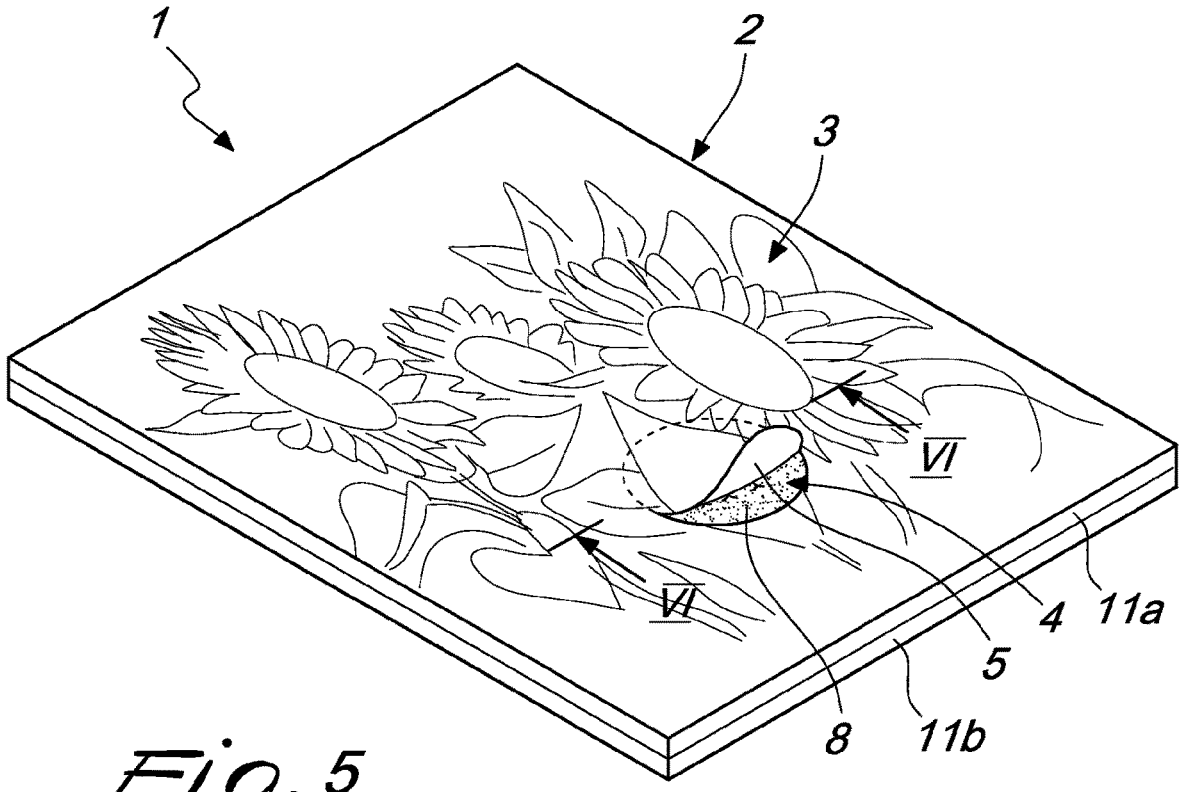
FIG. 5 shows the postcard according to the invention, in axonometric projection.

Moreover, in a f. phase, the procedure establishes to lay film 9 onto substrate 7 in order to, in a g. phase, close in a clamshell fashion the second portion lib onto the first portion 11*a* (or vice-versa) closing film 9 between substrate 7 and the second portion lib so that to complete de facto the production process of postcard 1 (FIG. 5).

In addition, it is expected to adopt more solutions to make that the two portions 11*a*, lib, once put together, keep that configuration. This process can be obtained, for example, by spreading come glue (such as vinyl glue, hot glue, etc) before g. phase, either on only one or on both portions 11*a*, lib on the areas that will come together after the folding.

Figure 4:
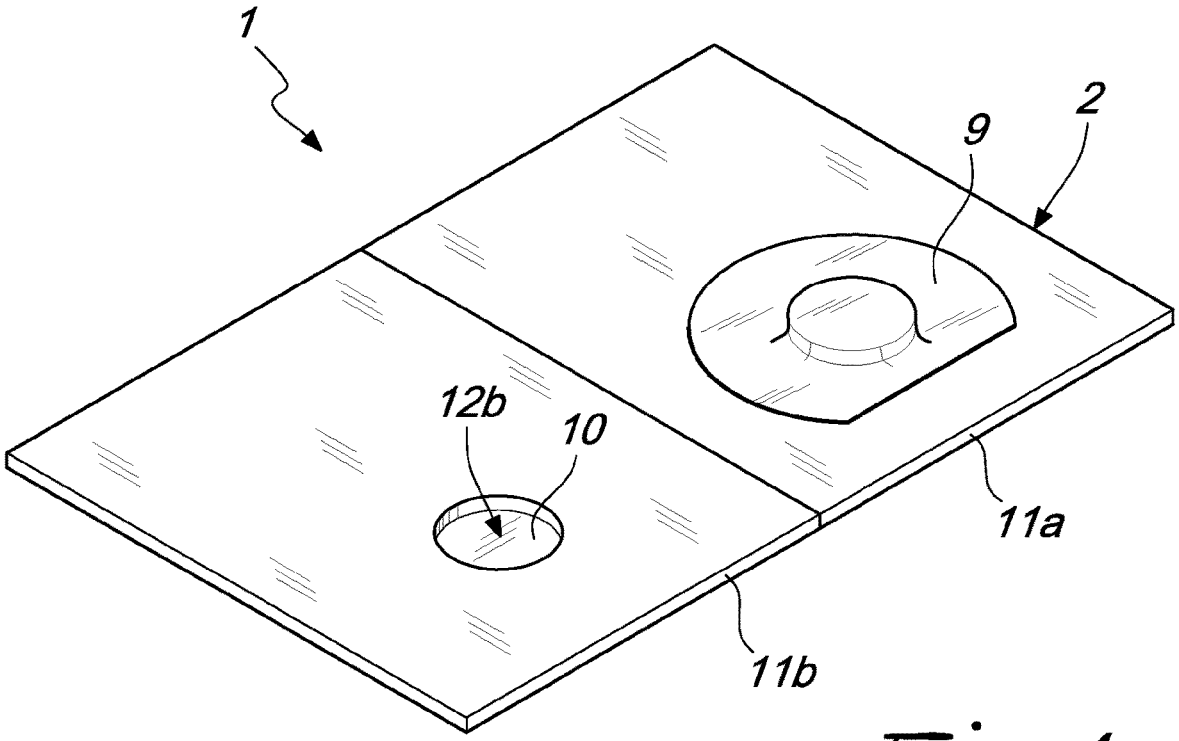

An important detail is, after f. phase and before g. phase, the possibility to push onto film 9 a small mould of the same shape as substrate 7, so to wrap around it film 9 and guarantee an ideal contention of humidity and water. The temporarily obtained configuration (which can be effortlessly done by hand as well without using the mould) is schematically explained in FIG. 4.

The use of the postcard according to the invention is the following.

As it has been already mentioned, it can be commercialized in souvenir and gift shops, such as in bookshops next to monuments and inside museums and art galleries by constituting a promotional gadget of any kind.

In this way the choice of the specific illustration 3 to be reproduced on postcard 1 may depend on the context in which the postcard is being commercialized and/or the message that is wished to be spread out or, more simply, may consist in an image thought to be particularly captivating.

In order to take advantage of the peculiar functionality conferred to the postcard 1 according to the invention, the user must cut sheet 10, in correspondence of the pre-cut flap that consists in the cover 5 so that it can be lifted (FIGS. 5 and 6) and removed.

Subsequently, it is enough to moisten substrate 7, or adding water into recess 4 to observe after few minutes already an enlargement of substrate 7 itself which tends to stick out and come out of recess 4 (due to the rehydration process, its dimension gets bigger).

As soon as substrate 7 is humid enough it is suggested to push the seeds at its inside in order to favour and facilitate the sprouting, which usually happens after few days (depending on the type of seed 6 and its germinating properties), especially because in the meantime the seeds 6 are being kept in close contact with the humid substrate 7.

Usually, after a few weeks the sprouts have grown to a point in which the plant needs more space, which makes its transplant necessary or highly suggested.

It's important to notice that the conformation chosen for the postcard 1 ensures an easy way of transplanting as well, because it is simply needed to pull out the substrate 7 and put it wherever you might like, putting it, for example, in a vase, without damaging the body 2 of the postcard 1 which remains intact.

The possibility of making grow (and transplant) a plant (thanks to seeds 6 and substrate 7, which are accommodated inside recess 4) gives postcard 1 a peculiar feature which can captivate the interest of the potential buyer.

As already noted, the presence of laminar body 8 allows to take advantage of said peculiar feature in a simple and practical way, due to the fact that the seeds 6 are stably retained on the top of the substrate 7 from the element 8 itself that melts on its own once water is being poured on recess 4 (thanks to the decision of having made it in a water-soluble material).

Moreover, it is well to observe that, as soon as the element 8 has been moistened, the substances of which it is made of (appropriately chosen) melt themselves with the seeds 6 and, by behaving as glue, tend to make them stick better to substrate 7. Maintaining regular the addition of water, said element 8 melts down and does not obstruct the growth of the plant.

The possibility of making grow a plant and the choice of eco-friendly materials turns the postcard 1 according to the invention an ecological gadget that answers to the needs of companies, authorities and associations' promotional campaigns that communicate and support development, innovation and cooperation in an "eco and green" way.

The invention, as it has been conceived, can be object of a great deal of changes and modifications, all of them part of the inventive concept. In addition, all the details cay be substituted with other elements technically equivalent.

In practice, the used materials and the dimensions may be any according to the needs and the state of the technique.

The invention claimed is:

1. A postcard, comprising a laminar body adapted to be decorated externally with at least one predefined illustration, characterized in that said body has an opening for access to an internal recess and comprises a removable cover, which closes, said opening, said recess accommodating at least one seed and a substrate for said at least one seed, arranged on the top of said substrate, directed toward said opening, for the sprouting of a plant following the removal of said cover and the addition of water in said recess, said at least one seed is retained on the top of said substrate by a laminar containment element, which is made of water-soluble material and is interposed between said substrate and said cover; the postcard being characterized in that it comprises a film made of water-repellent material, which is interposed between said recess and said substrate on a side opposite to said opening in order to contrast the diffusion of water and humidity in said body, after the addition of water in said recess.

2. The postcard according to claim 1, characterized in that said laminar element is a portion of water-soluble fabric, wrapped around said top of said substrate and around said at least one seed.

3. The postcard according to claim 1, characterized in that said substrate is a rigid block of material adapted to facilitate the optimum rooting of the plant, following the addition of water in said recess, said block having a shape and dimensions which substantially correspond to those of said recess, for its stable accommodation in said body.

4. The postcard according to claim 1, characterized in that said substrate is made of dried coconut pith fiber.

5. The postcard according to claim 1, characterized in that said substrate is at least partially wrapped in a containment net in order to prevent its dispersion and leakage.

6. The postcard according to claim 1, characterized in that said body comprises a plate-like base structure, which is made of cardboard and is provided with said recess, and at least one covering sheet, which is adapted to be decorated with said predefined illustration and stably applied on a face of said plate-like structure that is provided with said opening, said cover being constituted by a precut flap of said sheet, which is aligned with said opening.

7. The postcard according to claim 6, characterized in that said structure is composed of two plate-like portions which have substantially identical shape and dimensions, are folded in a clamshell fashion and are joined at a common edge, said recess being constituted substantially by respective aligned cavities provided in corresponding said portions.

8. A method for providing a postcard according to claim 7, which consists in: a, applying said covering sheet, optionally already decorated with said predefined illustration, on at least one part of a plate-like portion; b. die-cutting said plate-like portion, in order to form at least two mutually laterally adjacent portions, which are joined at said common edge and are provided with said cavities, said covering sheet being applied on at least one first portion; c. resting, on the opposite side with respect to said covering sheet, said laminar element on said first portion, at the respective said cavity; d, arranging said at least one seed on said laminar element, above the corresponding said cavity of said first portion; e, introducing said substrate in said cavity of said first portion, clamping said laminar element between said substrate and said covering sheet; f. resting said film on said substrate; g. closing in a clamshell fashion a second portion onto said first portion clamping said film between said substrate and said second portion.

* * * * *